US009672680B2

(12) United States Patent
Hajek et al.

(10) Patent No.: US 9,672,680 B2
(45) Date of Patent: Jun. 6, 2017

(54) COIN SEPARATING DEVICE

(71) Applicant: Wincor Nixdorf International GmbH, Paderborn (DE)

(72) Inventors: Daniela Hajek, Linz (AT); Christian Hameter, Unterweitersdorf (AT); Josef Eibensteiner, Wilhering (AT)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/915,931

(22) PCT Filed: Aug. 21, 2014

(86) PCT No.: PCT/EP2014/067797
§ 371 (c)(1),
(2) Date: Mar. 2, 2016

(87) PCT Pub. No.: WO2015/032626
PCT Pub. Date: Mar. 12, 2015

(65) Prior Publication Data

US 2016/0203664 A1 Jul. 14, 2016

(30) Foreign Application Priority Data

Sep. 5, 2013 (EP) ..... 13183214

(51) Int. Cl.
*G07F 1/04* (2006.01)
*G07D 9/00* (2006.01)
(Continued)

(52) U.S. Cl.
CPC ..... *G07D 9/008* (2013.01); *G07D 3/126* (2013.01); *G07D 3/14* (2013.01); *G07F 1/04* (2013.01)

(58) Field of Classification Search
CPC G07D 3/00; G07D 3/14; G07D 3/126; G07D 9/00; G07D 9/008; G07F 1/04
(Continued)

(56) References Cited

U.S. PATENT DOCUMENTS 3,361,141 A 1/1968 Weisskpf
5,366,407 A * 11/1994 Sentoku ..... G07D 3/14 453/17
(Continued)

FOREIGN PATENT DOCUMENTS

DE 1499552 A1 1/1971
DE 2843859 A1 4/1979
(Continued)

OTHER PUBLICATIONS

International Search Report. PCT/EP2014/067797 (Nov. 12, 2014) (4 pagesw).
(Continued)

*Primary Examiner* — Mark Beauchaine
(74) *Attorney, Agent, or Firm* — Gerald E. Hespos; Michael J. Porco; Matthew T. Hespos

(57) ABSTRACT

A coin separating device has a conveying device for conveying coins along a conveying section in a conveying direction from an input container, a checking device arranged on the conveying section for checking a coin conveyed along the conveying section and for providing a check result signal, a coin collecting device for collecting coins and a coin bridge device that is arranged between the coin collecting device and the conveying device and is realized to receive the check result signal and, in dependence on the check result signal, either to take over a conveyed coin from the conveying device by means of a movably arranged slide and supply it to the coin collecting device by means of the slide or not to take over a conveyed object from
(Continued)

the conveying device such that the conveyed object passes from the conveying device to a return means of the coin separating device.

14 Claims, 2 Drawing Sheets

(51) Int. Cl.
*G07D 3/12* (2006.01)
*G07D 3/14* (2006.01)

(58) Field of Classification Search
USPC ..... 194/346; 453/3
See application file for complete search history.

(56) References Cited

U.S. PATENT DOCUMENTS

| | | | | |
|---|---|---|---|---|
| 6,050,388 | A | 4/2000 | Gautherot | |
| 6,086,472 | A * | 7/2000 | Furukawa | G07D 3/14 194/346 |
| 6,637,576 | B1 * | 10/2003 | Jones | G07D 1/04 194/216 |
| 7,147,552 | B2 * | 12/2006 | Schimpl | G07D 9/008 221/254 |
| 2007/0062783 | A1 | 3/2007 | Hill | |
| 2010/0273409 | A1 | 10/2010 | Meyer-Steffens | |
| 2011/0281513 | A1 * | 11/2011 | Abe | G07D 1/00 453/3 |

FOREIGN PATENT DOCUMENTS

| | | | |
|---|---|---|---|
| DE | 69700386 | T2 | 2/2000 |
| EP | 0 940 777 | | 9/1999 |
| EP | 2242029 | A1 | 10/2010 |
| EP | 2 525 329 | | 11/2012 |
| GB | 2357885 | A | 7/2001 |
| WO | 2012/089353 | | 7/2012 |

OTHER PUBLICATIONS

Translation of Written Opinion of International Seaching Authoriy Dated Feb. 1, 2016. PCT/EP2014/067797 (5 pages).

* cited by examiner

COIN SEPARATING DEVICE

CROSS-REFERENCE TO A RELATED APPLICATION

This application is a National Phase Patent Application of International Patent Application No. PCT/EP2014/067797, filed on Aug. 21, 2014, which claims priority of European Patent Application Number 13183214.9, filed on Sep. 5, 2013.

BACKGROUND

The present invention relates to a coin separating device and to a method for operating a coin separating device.

A coin separating device of this type includes a conveying device for conveying coins in a conveying direction along a conveying section from an input container and a checking device which is arranged on the conveying section for checking a coin conveyed along the conveying section.

In the case of a coin separating device of this type which is disclosed, for example, in U.S. Pat. No. 7,147,552 B2 or WO 2012/089 353 A1, a conveying device is provided in the form of a two-strand conveyor belt, which realizes a conveying section along which coins are conveyed in an upward direction from an input container in opposition to a gravitational force. Entrainment means, which receive coins from the input container and convey them along the conveying section, are arranged on the conveyor belt. Various devices, which are to ensure that only one single coin is conveyed at each entrainment means, are provided distributed along the conveying section. In dependence on a check on the coins, that is to say in dependence on a respective check result, the coins are conveyed into a coin separating device, objects not recognized as coins being rejected and returned to the user.

These types of coin separating devices serve for separating coins from other objects. A sorting device, which sorts coins separated by the coin separating device and directs them in sorted form into collecting containers, can be connected downstream of a coin separating device.

The separating devices disclosed in U.S. Pat. No. 7,147,552 B2 and WO 2012/089 353 A1 each operate according to the so-called vertical separation principle. In the case of the vertical separation principle, coins are conveyed out of an input container, moved in an upward direction along a conveying section and, in dependence on a coin detection, supplied to a coin collecting device. Such coin separation devices are, as a rule, impervious to foreign bodies and can comprise a high degree of recognition accuracy. As a result of developing the conveying section in a suitable manner, where possible only coins should be conveyed along the conveying section, whilst other objects or counterfeited coins remain in the input container. In dependence on a check, checked coins and objects are then conveyed from the conveying section down into a coin collecting device for further processing of the coins or are rejected. In the case of the coin separating device disclosed in U.S. Pat. No. 7,147,552 B2, an electromagnetic ejector is provided, for example, for the purpose of conveying a checked coin from the conveying section into a coin collecting device.

SUMMARY

According to a first aspect of the present invention, a coin separating device with the features as described herein is presented. Characteristic further developments of the coin separating device according to the invention are provided in the sub-claims.

The coin separating device according to the invention, along with the usual conveying device and the coin collecting device, includes a coin bridge device which is arranged between said components and is realized to receive the check result signal of the checking device and, in dependence on the check result signal, either to take over a conveyed coin from the conveying device by means of a movably arranged slide and to supply it to the coin collecting device by means of the slide or, as an alternative to this, not to take over an object conveyed by the conveying device such that the conveyed object passes from the conveying device to a return means of the coin separating device and not into the coin collecting device.

The checking device provides the check result signal in dependence on the checking of the coins. For example, within the framework of the check, the checking device detects that the conveyed object is a coin which is to pass into the coin collecting device. In addition, a check as to the authenticity and/or foreign currency and/or denomination of the coin can be carried out. The important point for the actuation of the coin bridge device, however, is initially only that the check result indicates whether the conveyed object should pass into the coin collecting device or not.

If the check result signal indicates that the conveyed object is a coin to be collected, the coin bridge device thus takes over the conveyed coin from the conveying device and supplies it by means of the slide to the coin collecting device. The coin therefore slides along the slide toward the coin collecting device. If, in contrast, the check result indicates that the conveyed object is not to be collected in the coin collecting device, the coin bridge device does not then take over the conveyed object from the conveying device, but rather ensures that the conveyed object passes from the conveying device to the return means of the coin separating device, for example therefore into a foreign coin channel such that the object is able to be returned.

The conveyed object which is not to pass into the coin collecting device can be, for example, a counterfeited coin, a foreign coin, a different coin-like object or a coin which for whatever reason cannot pass into the coin collecting device, for example because the coin collecting device is at times overfilled, faulty or the like.

As a result of the movably arranged slide, which is, for example, in the form of a sliding rail, the conveyed coin is able to be supplied to the coin collecting device in a simple and energy-saving manner. No costly ejection or acceleration devices or similar are necessary and the coin taken over from the slide is able to be driven along the slide toward the coin collecting device essentially just by means of the force of gravity. No additional energy above that necessary for moving the slide toward the conveying device has to be applied in order to transport the conveyed coin from the conveying device toward the coin collecting device. Although the coin separating device according to the invention comprises a compact design and operates in an energy-saving manner, it is essentially impervious to foreign bodies.

The coin separating device according to the invention is accordingly distinguished by low energy consumption and by a simple, low-maintenance and reliable design.

Further embodiments of the coin separating device according to the invention are described below. The additional features of said further embodiments can be combined together to form further realization variants insofar as they are not described expressly as alternatives to one another.

The conveying section comprises a first end and a second end, wherein the input container may be arranged, for example, on the first end and the coin bridge device is realized for docking onto the second end by means of the slide to take over the conveyed coin. The term 'docking' is to be understood in the present case as the coin bridge device moving closer to the second end of the conveying section by means of the slide in such a manner that a coin conveyed by the conveying device is able to move onto the slide. It is not necessarily important for this purpose for the slide or another element of the coin bridge device to contact the conveying device directly. Rather, a small gap can even remain between the conveying section and the slide. Said configuration is also included in the present case by the term of 'docking'.

If a conveyed object is not to pass into the coin collecting device however, the coin bridge device may be realized e.g. so as, at a corresponding check result signal, to distance, that is to say to remove, the slide from the second end of the conveying device such that between the slide and the second end of the conveying section there is a space which is dimensioned in such a manner that the object conveyed by the conveying device passes to the return means of the coin separating device and not to the slide. For example, in this case the conveyed object falls into a foreign coin channel.

For example, the slide of the coin bridge device comprises a pick-up part and an ejector part, wherein the pick-up part is developed for coupling to the second end of the conveying section and the ejector part is developed for transferring the coin from the slide to the coin collecting device. The pick-up part ensures that the conveyed coin is able to pass from the conveying device to the slide, e.g., in such a way that the coin is not turned at the same time.

For example, the second end of the conveying section includes a wheel-shaped guide element. In the case of said variant, for example the pick-up part of the slide may include an end face which is arranged parallel to a fictitious tangent of the wheel-shaped guide element. As a result, the slide is able to be moved very close to the second end of the conveying section for the purposes of taking over the conveyed coin without obstructing the operation of the conveying section, e.g. without contacting the conveying section directly with the pick-up part.

Once the conveyed coin has been taken over by means of the pick-up part of the slide, the coin slips along the slide to the coin collecting device on account of the gravitational force acting thereon. The coin passes into the coin collecting device by means of the pick-up part of the slide. The ejector part of the slide is formed, for example, by a rounded or angled edge which ensures that the coin passes unerringly into the coin collecting device.

For example, the coin bridge device comprises a drive which is coupled to the slide by means of a coupling member and is realized, in dependence on the check result signal, either to move the slide toward the conveying device for taking over the conveyed coin such that the conveyed coin passes onto the slide and is able to slide to the coin collecting device by means of said slide, or to move the slide away from the conveying device such that the object conveyed by the conveying device passes to the return means. The drive is, for example, a stepping motor.

If the check result signal therefore indicates that the conveyed coin is to pass into the coin collecting device, the drive then moves the slide toward the second end of the conveying section such that the coin passes onto the slide from the conveying section, slips down along said slide and reaches the coin collecting device. If, in contrast, the check result signal indicates that the conveyed coin is not to pass into the coin collecting device, the drive thus moves the slide away from the second end of the conveying section such that the conveyed object (such as a foreign coin or a counterfeited coin) does not pass onto the slide, but from the conveying section to the return means, for example to a steeply arranged foreign coin channel. As a result of removing the slide from the conveying section, a gap is created between the second end of the conveying section and the pick-up part of the slide which is dimensioned such that the object does not pass onto the slide, but falls through the gap, for example into the foreign coin channel.

For example, the coupling member comprises a recess in which a protruding element of the slide engages for coupling the slide to the drive. The protruding element is arranged in such a manner that it does not obstruct the sliding movement of the coin. The protruding element and the recess accordingly realize an articulation which translates the movement of the drive into a movement of the slide. For example, the articulation translates a rotational movement of the drive into a transverse movement of the slide.

When the coin separating device is arranged and used as intended, the conveying direction is directed with at least one direction vector component in opposition to a direction of gravity. The coin separating device consequently operates according to the vertical separating principle, by coins being conveyed in an upward direction along the conveying section from the input container. The conveying direction, in this respect, does not have to be directed precisely vertically in opposition to the direction of gravity (that is to say in opposition to the direction in which gravity acts), but may, e.g., point at an angle to the direction of gravity in such a manner that one direction vector component of the conveying direction is directed in opposition to the direction of gravity.

It may further be provided that when the coin separating device is arranged and used as intended, the slide is directed with at least one direction vector component in the direction of gravity. To this end, the slide includes a slide top surface which is realized in a substantially flat manner and is arranged in a steep manner. For example, the slide top surface comprises a material which has a lower coefficient of friction than a coin material, such as copper, steel, Nordic gold, nickel, brass, cupronickel or corresponding alloys. For example, the slide therefore leads from the second end of the conveying section down to an entry into the coin collecting device. An angle of inclination in relation to the horizontal, in this case, is for example between 5° and 40°. Depending on the application, however, a flatter or steeper angle of inclination can be chosen for the slide.

Along with the slide top surface, the slide may, for example, comprise at least one side strip which is realized so as to hold a coin sliding along the slide top surface in the track and to prevent it from leaving the coin bridging device at the sides of the slide top surface and missing an entry into the coin collecting device. As a result, the coin separating device is less susceptible to vibrations.

In an further development, the conveying device comprises a conveyor belt with two synchronously moved conveying strands which extend parallel to one another along the conveying direction. The conveying strands can each be realized by a circulating conveyor belt, the conveyor strands being moved in a synchronous manner and consequently together conveying coins from the input container. At least one entrainment means is arranged on each conveying strand, one entrainment means of the one conveying strand and one entrainment means of the other conveying strand forming an entrainment pair for entraining in each case one coin.

The coin collecting device serves for catching and collecting the coins supplied by means of the coin bridge device. The coin collecting device, in this connection, can comprise a sorting device for sorting the coins supplied to the coin collecting device, which is realized e.g. to direct each coin, dependent on a coin type, that is to say, for example, in dependence on the respective denomination, into a coin collecting container which is associated with the coin type. The coin type can already be detected, for example, by means of the checking device of the conveying device such that the coin type of the coin is already ascertained when it is supplied to the coin collecting device by means of the coin bridge device. Dependent on the coin type, the coin is then processed further and supplied to a coin collecting container associated therewith such that a one Euro coin passes into a collecting container for one Euro coins.

The sorting device can comprise, for example, an adjustable sorting funnel which receives the coin to be sorted at an inlet and can be moved with an outlet toward an entry into a collecting container associated with the coin type of the coin to be sorted such that the coin is supplied to the associated collecting container by means of the sorting funnel.

In addition, the coin collecting device can comprise a control device, for example in the form of a simple light barrier or in the form of a more complex checking device for detecting a coin inclusive of its coin type. The control device is realized (at least) to detect the presence of a coin in the coin collecting device in order to verify in this way, for example, that a coin that has been checked by the checking device and conveyed toward the coin collecting device by the coin bridge device, also really has reached the coin collecting device. If the control device ascertains that no coin has been detected within a predetermined time period, although after the check by the checking device of the conveying device and after being conveyed by the coin bridge device, a coin should have passed into the coin collecting device, this thus points to the fact that there is a fault on the side of the conveying device, for example because the coin takeover by the coin bridge device has failed and the coin which was checked positively has consequently not reached the coin collecting device. In this case, the coin is not registered. It is rather registered for further processing as the coin did not reach the coin collecting device.

As a result of the control device being arranged at a predetermined location, for example in a channel of the coin collecting device, it can also be determined by means of the control device of the coin collecting device when the coin supplied to the coin collecting device has reached the location of the control device. In dependence on a detection signal of the control device, a sorting device connected downstream can also consequently be controlled, for example, in dependence on a detection signal of the control device, by an adjusting movement of the sorting device being triggered for supplying the coin toward an associated collecting container.

According to a second aspect of the present invention, a method for operating a coin separating device as described herein is presented.

The developments described above for the coin separating device, e.g. as provided in the sub-claims, are also applied analogously to the method for operating the coin separating device. The method may serve for operating a coin separating device of the previously described type.

BRIEF DESCRIPTION OF THE DRAWINGS

The concept underlying the invention is to be explained in more detail below by way of the exemplary embodiments shown in the figures.

DETAILED DESCRIPTION

Figure 1:
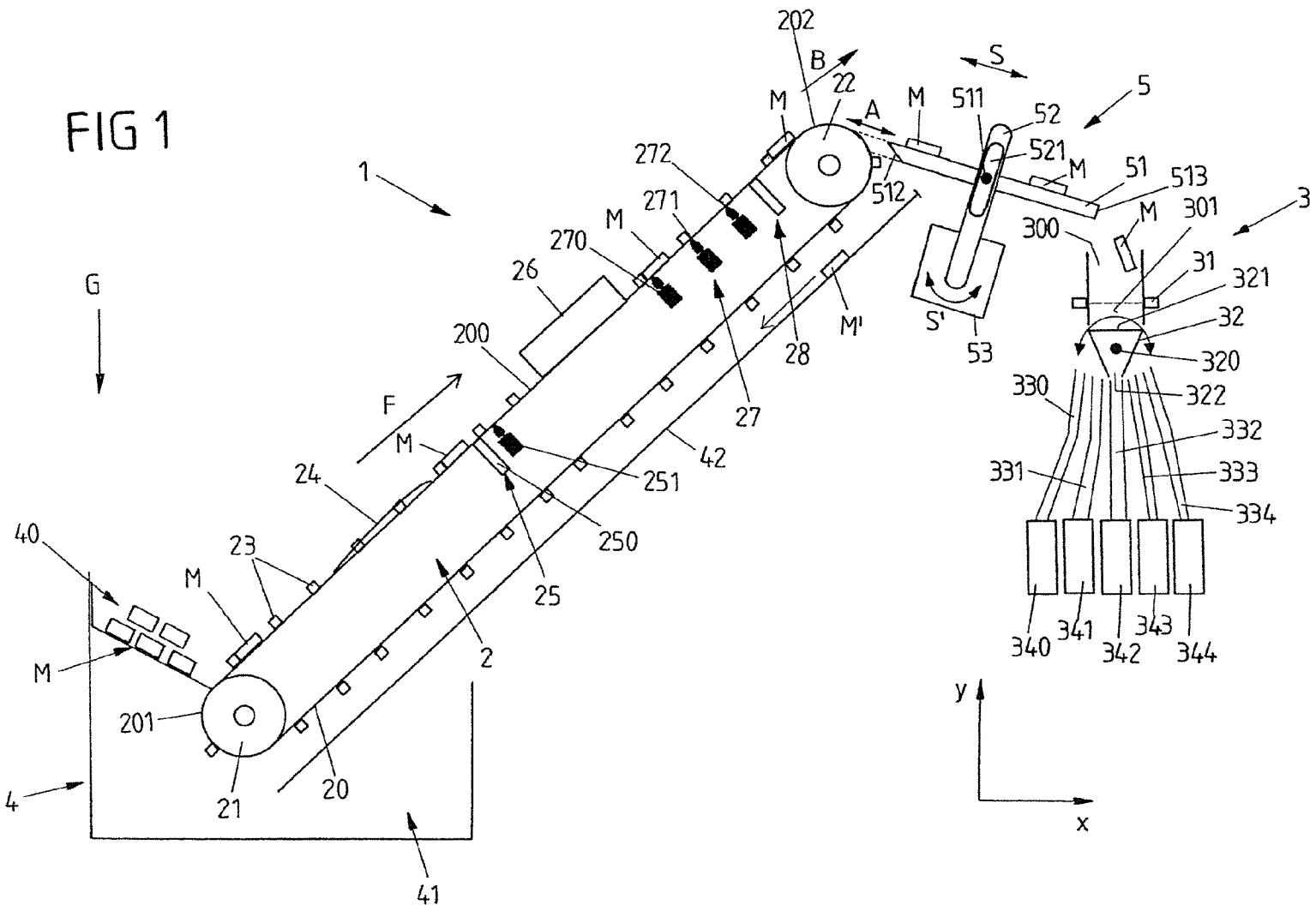
FIG. 1 shows a schematic representation of a cross-sectional view of a coin separating device according to the invention with a conveying device and a coin collecting device.
Figure 2:
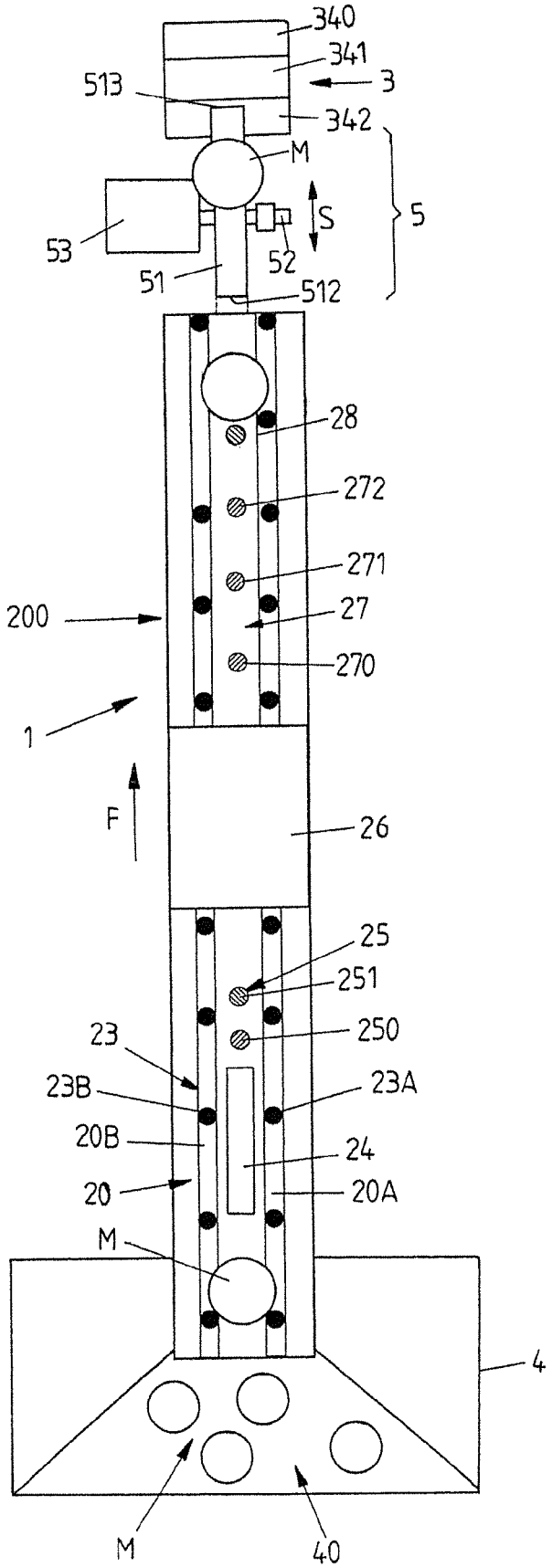
FIG. 2 shows a schematic representation of a top view of a coin separating device according to the invention.

FIGS. 1 and 2 show exemplary embodiments of a coin separating device 1 which comprises a conveying device 2 for conveying coins M from an input container 40 along a conveying section 200 toward a coin collecting device 3. The conveying section 200 comprises a first end 201 and a second end 202, the input container 40 being arranged at the first end 201. A driven coin bridge device 5 is provided for transferring a conveyed coin M toward the coin collecting device 3. The operation and design of the coin separating device 1 is described in more detail below with reference to the two FIGS. 1 and 2.

The conveying device 2 is realized as a conveyor belt with two synchronously driven conveyor strands 20A, 20B which extend parallel to one another. Each conveyor strand 20A, 20B, in this connection, is realized by a circulating conveyor belt, the conveying strands 20A, 20B being guided on identical guide elements 21, 22 in the form of guide rollers and being driven in a synchronous manner for a movement in a same direction at a same speed. The conveyor strands 20A, 20B are, for example, in each case endless belts.

The conveyor belt 20 formed by the conveyor strands 20A, 20B serves for the purpose of conveying coins M from the input container 40 in a conveying direction F along the conveying section 200. The conveying device 2 realizes, in this connection, the so-called vertical separating principle, by the conveying direction F being directed with one direction vector component in opposition to the direction of gravity G (i.e. the conveying direction F can be broken down into vector components, one of which is established in opposition to the direction of gravity G). Coins M are consequently conveyed up at an angle (upward) from the input container 40 along the conveying direction F with reference to the direction of gravity G, entrainment pairs 23 being realized on the conveying strands 20A, 20B for this purpose, which entrainment pairs are realized in each case by a first entrainment means 23A arranged on the one conveyor strand 20A and a second entrainment means 23B arranged on the other conveyor strand 20B. Bolts can be considered, for example, as entrainment means 23A and 23B. For reasons of clarity, not all the entrainment means shown in FIGS. 1 and 2 are provided with reference symbols, but only a selection for illustration purposes, said selection having no further significance.

To convey a coin M from the input container 40, one entrainment pair 23 is moved right through the input container 40 and in this way grasps a coin M, which—as shown in FIG. 1 and FIG. 2—comes to rest on the conveying strands 20A, 20B and is held between the entrainment means 23A, 23B of the entrainment pair 23. By moving the conveyor strands 20A, 20B in the conveying direction F, the coin M is then moved along the conveying section 200 in the conveying direction F, the movement of the conveyor strands 20A, 20B being effected continuously and consequently coins M are taken successively from the input container 40 and conveyed along the conveying section 200.

When a coin M is taken from the input container 40, several coins M can come to rest on one entrainment pair 23, for example by two coins being located one on top of the other or by one coin M on one entrainment pair 23 pushing a further coin M in front of it.

Consequently, first of all a ramp 24 is arranged on the conveying section 200 and then connecting thereto in the conveying direction F an ejecting device 25, both of which are to ensure that only precisely one coin M is conveyed at each entrainment pair 23. If a coin M conveyed on an entrainment pair 23 reaches the ramp 24, it runs along said ramp and is consequently offset (slightly) perpendicular to the conveying direction F on the entrainment pair 23 associated therewith. In this way, the coin M is raised from the conveyor strands 20A, 20B, which results in a second coin M which is arranged on the coin M sliding from the entrainment means 23A, 23B of the entrainment pair 23 and consequently falling from the conveyor belt 20.

After the ramp 24, the coin M passes to the ejecting device 25 which comprises a, for example, inductively realized sensor 250 and an ejector 251 which is connected downstream in the conveying direction F and is, for example, realized in an electromagnetic manner. If it is detected by means of the (inductive) sensor 250 that a coin M on an entrainment pair 23 is pushing a further coin M in front of it, the ejector 251 is actuated in a corresponding manner and the further coin is ejected.

After the ramp 24 and the ejecting device 25, it is consequently ensured that only precisely one coin M is conveyed on an entrainment pair 23. The coin M then passes to a checking device 26 which is arranged on the conveying section 200 and serves for the purpose of checking a coin, e.g. of detecting whether the conveyed object is a coin M that is to be processed further or another object, for example a foreign body (counterfeited coin) or a coin that cannot be processed further because it originates, for example, from another currency (foreign coin). In dependence on the check, which can be performed, for example, by way of diameter detection, weight detection and/or by way of optical pattern detection, a check result signal is generated which serves for actuating a coin bridge device 5, as is to be explained again in more detail below.

After running through the checking device 26, a coin M passes to an ejecting device 27, which comprises ejectors 270, 271, 272 for selectively ejecting the coin M from the conveyor belt 20. Two of the ejectors 270, 271, 272 serve in this connection for the purpose of ejecting coins M with extreme characteristics (e.g. extremely light or extremely heavy coins M or coins M with an extraordinary form, e.g. angular coins). A third one of the ejectors 270, 271, 272 serves for the purpose of selectively ejecting a coin M, when the coin M has certainly been detected and verified, but then, however, it is ascertained that the coin collecting device 3 connected downstream is not capable of receiving the coin M and processing it further, for example because a container associated with the coin M is full and consequently is no longer able to receive any more coins M.

Connected downstream of the ejecting device 27 in the conveying direction F on the conveying section 200 is a control device 28 which serves for the purpose of checking the correct ejection of a coin M—if this is to be have been effected—at the ejecting device 27. The control device 28 is developed as an inductive sensor, for example, which checks whether a metal coin M, which should have been ejected by the ejecting device 27, actually has been ejected and to this end, generates a signal inductively when the coin M potentially passes.

After passing the devices 27 and 28, a coin M which is guided on an entrainment pair 23—if it has not been ejected up to now, but rather has been detected and verified by the checking device 26—is supplied to the coin collecting device 3 for further processing. The coin bridge device 5 is arranged between the conveying device 2 and the coin collecting device 3 for this purpose.

The coin bridge device 5 includes a movably arranged slide 51 and a drive 53, for example in the form of a stepping motor, which is coupled to the slide 51 by means of a coupling member 52. The coin bridge device 5 is realized for docking onto the second end 202 of the conveying section 200 for taking over the conveyed coin M by means of the slide 51.

The coin bridge device 5 receives the check result signal. In dependence on the check result signal, the coin bridge device 5 either takes over a conveyed coin M from the conveying device 2 by means of the movably arranged slide 51 and supplies it to the coin collecting device 3. As an alternative to this, the coin bridge device 5 does not take over a conveyed object M' from the conveying device 2. The conveyed object M', in this case, consequently passes from the conveying device 2 to a return means 42, for example in the form of a foreign coin channel 42.

If the check result signal therefore indicates that the conveyed object is a coin M to be collected, the coin bridge device 5 thus takes over the conveyed coin M from the conveying device 2 and supplies it to the coin collecting device 5. If, in contrast, the check result signal indicates that the conveyed object is not to be collected in the coin collecting device 3, the coin bridge device 5 does not take over the conveyed object from the conveying device 2, but ensures that the conveyed object M' passes from the conveying device 2 to the return means 42 of the coin separating device 1, for example therefore into a foreign coin channel.

The conveyed object M', which is not to pass into the coin collecting device 3, can be, for example, a counterfeited coin, a foreign coin, another coin-like object or a coin which for whatever reason cannot pass into the coin collecting device, for example because the coin collecting device is at times overfilled, faulty or the like.

To take over the conveyed coin M, the drive 53 moves the slide 51 to the second end 202 of the conveying section 200 such that a pick-up part 512 docks onto the second end 202. The pick-up part 512 of the slide 51 includes for this purpose an end face which is arranged parallel to a fictitious tangent of the guide roller 22. As a result, the slide 51 is able to be moved very close to the second end 202 of the conveying section 200 for the purposes of taking over the conveyed coin M without obstructing the operation of the conveying section 200, e.g. without contacting the conveying section 200 directly with the pick-up part. The coin M then automatically slides onto the slide 51 as a result of the force of gravity and of the development of the conveying section 200.

After the conveyed coin M has been received by means of the pick-up part 512 of the slide 51, the coin M slips along the slide 51 toward the coin collecting device 3 as a result of the gravitational force acting on it and as a result of the steep arrangement of the slide 51. The coin M passes into the coin collecting device 3 by means of an ejector part 513 of the slide. The ejector part 513 of the slide 51 is formed, for example, by a rounded or angled edge which ensures that the coin M passes unerringly into the coin collecting device 3.

If, in contrast, the check result signal indicates that the conveyed object M' is not to pass into the coin collecting device 3, the drive 53 thus moves the slide 51 away from the second end 202 of the conveying section 200 such that the conveyed object M' (such as a foreign coin or a counterfeited coin) does not pass onto the slide 51, but from the conveying section 200 falls in the direction of the return means 42 which is developed as a steeply arranged foreign coin channel in the case of the exemplary embodiment according to FIG. 1. To this end, the coin bridge device 5 forms between the second end 202 of the conveying device 2 and the slide 51 a space A which is dimensioned in such a manner that the conveyed object falls from the conveying device 2 into the foreign coin channel 42 of the coin separating device 1 and not onto the slide 51.

In the case of the examples shown in FIG. 1 and FIG. 2, the slide 51 is only arranged so as to be movable in sliding directions S. The sliding directions S point along a steep straight line from the second end 202 of the conveying section 200 down to an entry 300 in the coin collecting device 3 or along an ascending straight line from said entry 300 up to the second end 202 of the conveying section 200. The drive 51 executes a rotational movement in the sliding directions S' which is converted by the coupling member 52 into transverse movements, that is to say sliding directions S, of the slide 51. To this end, the coupling member 52 comprises a recess 521 in which a protruding element 511 of the slide 51 engages in a movable manner.

The drive 51 can be coupled to the slide 51 in various configurations. Two of said configurations are shown schematically in FIG. 1 and FIG. 2. In the case of FIG. 1, the protruding element 511 is arranged at the side. The protruding element 511 can also, however, as shown in FIG. 2, be arranged below the slide 51.

A conveyed object M' (for example a foreign coin, counterfeited coin or a coin which is not to pass into the coin collecting device 3) which is still situated on the conveyor belt 20 on the second end 202 of the conveying section 200 and consequently has passed all the devices 24, 25, 26, 27, 28 on the conveying section 200, is conveyed beyond the second end 202 of the conveying section 200, in this case, however, falls through the gap created by the space A between the second end 202 of the conveying section 200 and the pick-up part 512 of the slide 51 into the foreign coin channel 42, which conveys the object M' (see FIG. 1) back into a collecting container 41 of a returning device 4 and consequently can return it to a user.

The coin collecting device 3 catches a coin M, which has been transported by means of the coin bridge device 5 from the conveying section 200 toward the coin collecting device 3, at its entry 300 and directs the coin M by means of the channel 30 toward a sorting device 32 in the form of a sorting funnel which is pivotable about a pivot axis 320. Before the coin M, in this case, reaches the sorting device 32, it passes a further control device 31 which serves for the purpose of detecting the coin M in order to verify that the coin M has actually reached the coin collecting device 3. In addition, when the coin M passes the further control device 31 (which can be realized as a light barrier for example), a position signal can be generated which can be used for triggering a movement adjusting the sorting device 32 in order to direct the coin M for suitable sorting into a coin collecting channel 330-334 and a coin collecting container 340-344 which is connected downstream of the coin collecting channel 330-334.

When reaching the sorting device 32, the coin M passes into a funnel-shaped inlet 321 of the sorting device 32 and is supplied by means of an outlet 322 to the associated coin collecting channel 330-334 and then to the associated coin collecting container 340-344.

For example, each coin type can have associated therewith a coin collecting container 340-344. Thus, a one Euro coin can be directed, for example, into a coin collecting container 340-344 in which one Euro coins are collected. The same applies to coins of other coin types.

The concept underlying the invention is not limited to the previously depicted exemplary embodiments, but can also be realized in principle with completely different embodiments.

For example, the conveying device does not necessarily have to realize the vertical separating principle. For example, it is also possible to provide a conveying device for separating coins which comprises a substantially horizontally extending conveying section.

The top surface of the slide can be shaped flat or can comprise a curved development, for example it can be parabolic. The important point is that it extends in a steep manner when viewed from the second end of the conveying section, toward the entry in the coin collecting device. The width of the slide can be arbitrarily chosen as long as it is ensured that a coin taken over slips unerringly in the direction of the entry into the coin collecting device.

In the case of the drive of the coin bridge device, other driving means can also be considered along with the stepping motor. Conceivable, for example, is a magnetic means that, on receipt of a corresponding check result signal, attracts the bridge toward the second end of the conveying device (or repels it to there) such that the coin conveyed by the conveying device and to be collected is able to pass onto the slide and from there move into the coin collecting device. If a conveyed object, such as, for example, a foreign or counterfeited coin, is not to be collected, the magnetic means are not actuated such that on account of the gap remaining between the slide and the second end of the conveying device, the conveyed object passes to the return means of the coin separating device and not to the slide. Along with the stepping motor, the magnetic means form only one of several possibilities for realizing the above-explained principle of operation of the coin bridge device.

LIST OF REFERENCES

1 Coin separating device
2 Conveying device
20 Conveyor belt
200 Conveying section
201, 202 End
20A, 20B Conveyor strand
21, 22 Guide element
23 Entrainment pair
23A, 23B Entrainment means
24 Ramp
25 Ejecting device
250 (Inductive) sensor
251 Ejector
26 Checking device
27 Ejecting device
270, 271, 272 Ejector
28 Control device
3 Coin collecting device
30 Channel
300 Entry

301 Exit
31 Further control device
32 Sorting device
320 Pivot axis
321 Inlet
322 Outlet
330 to 334 Coin collecting channel
340 to 344 Coin collecting container
4 Return device
40 Input container
41 Collecting container
42 Return means
5 Coin bridge device
51 Slide
511 Protruding element
512 Pick-up part
513 Ejecting part
52 Coupling member
521 Recess
53 Drive
A Space
F Conveying direction
G Direction of gravity
S Sliding directions
S' Drive directions
M Coin
M' Object
x Horizontal direction
y Vertical direction

The invention claimed is:

1. A coin separating device, comprising a conveying device having opposite upstream and downstream ends and a conveying section between the ends, the conveying device being configured for conveying coins along the conveying section in a conveying direction from an input container in proximity to the upstream end to the downstream end;

a checking device arranged on the conveying section for checking a coin conveyed along the conveying section and for providing a check result signal that distinguishes between acceptable coins and unacceptable objects;

a coin collecting device spaced downstream from the downstream end of the conveying device for collecting the acceptable coins; and a coin bridge device arranged between the coin collecting device and the conveying device and communicating with the checking device to receive the check result signal, the coin bridge device having a slide with a pick-up end facing the downstream end of the conveying device and an ejector end gravitationally lower than the pick-up end and gravitationally above the coin collecting device, and a drive that positions the pick-up end of the slide into proximity with the downstream end of the conveying device when the check result signal indicates an acceptable coin so that the acceptable coin slides gravitationally along the slide from the conveying device to the coin collecting device and that moves the pick-up end of the slide away from the downstream end of the conveying device when the check result signal indicates an unacceptable object such that the conveyed unacceptable object falls gravitationally from the downstream end of the conveying device to a return means of the coin separating device.

2. The coin separating device as claimed in claim 1, wherein the drive of the coin bridge device is coupled to the slide by a coupling member.

3. The coin separating device as claimed in claim 2, wherein the drive includes a stepping motor.

4. The coin separating device as claimed in claim 2, wherein the coupling member comprises a recess in which a protruding element of the slide engages for coupling the slide to the drive.

5. The coin separating device as claimed in claim 1, wherein when the coin separating device is arranged and used as intended, the conveying direction is directed with at least one direction vector component in opposition to a direction of gravity.

6. The coin separating device as claimed in claim 1, wherein the slide includes a substantially flat slide top surface that is arranged in a steep manner.

7. The coin separating device as claimed in claim 1, wherein the slide comprises a side strip.

8. The coin separating device as claimed in claim 1, wherein the conveying device comprises a conveyor belt with two synchronously moved conveying strands that extend parallel to one another along the conveying direction, wherein at least one entrainment means is arranged on each conveying strand and one entrainment means of the one conveying strand and one entrainment means of the other conveying strand form an entrainment pair for entraining a coin.

9. The coin separating device as claimed in claim 1, wherein the coin collecting device comprises a sorting device for sorting the coins supplied to the coin collecting device.

10. The coin separating device as claimed in claim 9, wherein the sorting device directs each coin in dependence on a coin type into a coin collecting container of the coin collecting device associated with the coin type.

11. The coin separating device as claimed in claim 9, wherein the coin collecting device comprises a control device configured to detect a coin in the coin collecting device.

12. The coin separating device as claimed in claim 1, wherein the drive is operative to move the slide substantially linearly.

13. The coin separating device as claimed in claim 1, wherein the pick-up end of the slide has a surface aligned parallel to a tangent of a roller at the downstream end of the conveying device.

14. A method for operating a coin separating device, wherein the coin separating device comprises:

conveying objects along a conveying section in a conveying direction from an input container;

sequentially checking the objects conveyed along the conveying section and providing a check result signal to indicate whether each object is an acceptable coin or an unacceptable object; and operating a coin bridge device to position a pick-up end of a slide adjacent a downstream end of the conveying device when the check result signal indicates an acceptable coin so that the acceptable coin is deposited on the pick-up end of the slide and slid gravitationally down along the slide for deposition in a coin collecting device, and moving the pick-up end of the slide away from the downstream end of the conveying device when the check result signal indicates an unacceptable object such that the unacceptable object falls gravitationally from the downstream end of the conveying device to a return means of the coin separating device.

* * * * *